US006457841B1

(12) United States Patent
Lynch et al.

(10) Patent No.: US 6,457,841 B1
(45) Date of Patent: Oct. 1, 2002

(54) FLASHLIGHT HAVING A PIVOTING HEAD

(75) Inventors: Peter F. Lynch; Scott W. Osiecki, both of Skaneateles; Timothy R. Fitch, Syracuse, all of NY (US); David R. Dalton, North Turramurra (AU)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 09/689,064

(22) Filed: Oct. 12, 2000

Related U.S. Application Data

(60) Provisional application No. 60/158,928, filed on Oct. 12, 1999.

(51) Int. Cl.[7] ..... F21L 7/00

(52) U.S. Cl. ..... 362/199; 362/197; 362/205; 362/287

(58) Field of Search ..... 362/197, 199, 362/205, 287, 427, 428, 429

(56) References Cited

U.S. PATENT DOCUMENTS

| | | | | |
|---|---|---|---|---|
| 4,422,130 | A | | 12/1983 | Shigeo |
| 4,428,033 | A | | 1/1984 | McBride |
| 4,447,863 | A | | 5/1984 | Fenne |
| 4,459,646 | A | | 7/1984 | Drane |
| 4,533,982 | A | | 8/1985 | Kozar |
| 4,654,764 | A | | 3/1987 | Hsiao |
| 4,777,572 | A | | 10/1988 | Ambasz |
| 5,012,394 | A | | 4/1991 | Woodward |
| 5,043,854 | A | | 8/1991 | Gammache |
| 5,097,399 | A | | 3/1992 | Gammache |
| 5,161,095 | A | | 11/1992 | Gammache |
| D332,320 | S | | 1/1993 | Gammache |
| 5,278,739 | A | | 1/1994 | Gammache |
| 5,357,411 | A | | 10/1994 | Menke et al. |
| 5,410,457 | A | | 4/1995 | Parker |
| 5,530,633 | A | | 6/1996 | Yuen |
| 5,541,822 | A | | 7/1996 | Bamber |
| 5,558,430 | A | | 9/1996 | Booty, Jr. |
| D375,811 | S | | 11/1996 | Hon |
| 5,605,394 | A | | 2/1997 | Chen |
| 5,684,452 | A | * | 11/1997 | Wang ..... 340/321 |
| 5,853,241 | A | | 12/1998 | Sharrah et al. |
| 5,871,272 | A | | 2/1999 | Sharrah et al. |
| D406,372 | S | | 3/1999 | Matthes et al. |
| 5,988,828 | A | * | 11/1999 | Prince et al. ..... 362/191 |
| 5,993,022 | A | * | 11/1999 | Neyer et al. ..... 362/199 |
| 6,012,824 | A | * | 1/2000 | Sharrah et al. ..... 362/199 |
| 6,186,638 | B1 | * | 2/2001 | Chang ..... 362/119 |

FOREIGN PATENT DOCUMENTS

| | | |
|---|---|---|
| DE | 3829337 | 3/1990 |
| DE | 29818529 | 2/1999 |
| EP | 0036450 | 3/1984 |
| GB | 2238861 | 6/1991 |
| JP | 10228801 | 8/1998 |
| WO | 9325408 | 12/1993 |
| WO | 9714912 | 4/1997 |

* cited by examiner

*Primary Examiner*—Sandra O'Shea
*Assistant Examiner*—Anabel Ton
(74) *Attorney, Agent, or Firm*—Robert W. Welsh

(57) ABSTRACT

A flashlight is disclosed having a body and a flashlight head in which a light bulb is mounted. The body includes a housing that defines a battery compartment, a pair of arms extending from a front end of the housing for mounting the flashlight head between opposing ends of the arms such that the flashlight head may be pivoted relative to the body, and a thumb wheel rotatably mounted in the housing and extending partially through the housing to engage the flashlight head such that the flashlight head pivots relative to the body as the thumb wheel is rotated. The thumb wheel may include gear teeth about its perimeter for engaging gear teeth formed in the round rear surface of the flashlight head.

17 Claims, 5 Drawing Sheets

FLASHLIGHT HAVING A PIVOTING HEAD

CROSS-REFERENCE TO RELATED APPLICATION

This application claims priority under 35 U.S.C. §119(e) on U.S. Provisional Patent Application No. 60/158,928 entitled "FLASHLIGHT HAVING A PIVOTING HEAD" and filed on Oct. 12, 1999, the entire disclosure of which is incorporated herein by reference.

BACKGROUND OF THE INVENTION

The present invention generally relates to flashlights, and more particularly relates to flashlights having pivoting heads.

Flashlights are known that have a head portion, which contains a light bulb, reflector, and lens, and is pivotably mounted to a body portion of the flashlight. The body portions of these flashlights are of various shapes and sizes and are often configured to allow the flashlight to be set on a table or worksurface, such that the flashlight head may be pivoted so as to direct light downwardly onto the worksurface. These flashlights may also be carried with the flashlight head pivoted to direct light in a forward direction and thus operate as a conventional flashlight or lantern. Thus, pivoting head flashlights can be used as a regular flashlight, but unlike regular flashlights, pivoting head flashlights may also be used as a tabletop area/task light.

The prior art pivoting head flashlights are generally not ergonomically designed and do not allow a person to hold the flashlight in a conventional manner with a single hand while at the same time pivoting the head of the flashlight without using their other hand. Because these types of flashlights are often used to illuminate areas in which the person is performing tasks, there exists a need for a flashlight that would enable a person to manipulate the pivoting of the flashlight head using a single hand and without requiring the person to change their grip on the flashlight.

SUMMARY OF THE INVENTION

Accordingly, it is an aspect of the present invention to solve the above problems pertaining to pivoting head flashlights by providing a flashlight that enables a person to pivot the flashlight head using the same hand with which the person is holding the flashlight and without requiring the person to change their grip. It is another aspect of the present invention to not only enable a person to manipulate the position of the flashlight head using the same hand with which they are holding the flashlight, but to also enable the person to manipulate an on/off switch without requiring the person to change their grip on the flashlight.

To achieve these and other aspects and advantages, the flashlight constructed in accordance with the present invention comprises a flashlight head, which includes a light bulb, and a body, which includes a housing that defines a battery compartment, a pair of arms extending from a front end of the housing for mounting the flashlight head between opposing ends of the arms, such that the flashlight head may be pivoted relative to the body, and a thumb wheel rotatably mounted in the housing and extending partially through the housing to engage the flashlight head, such that the flashlight head pivots relative to the body as the thumb wheel is rotated.

An additional aspect of the present invention is to provide a pivoting head flashlight having a generally elongated body similar to a conventional flashlight while having the head pivotable such that light directed from the flashlight head impinges upon a worksurface upon which the opposite end of the flashlight rests. To achieve this and other aspects and advantages of the present invention, the flashlight of the present invention comprises a flashlight head, which includes a light bulb, and a body, which includes a housing that defines a battery compartment, a pair of arms extending from a front end of the housing for mounting the flashlight head between opposing ends of the arms, such that the flashlight head may be pivoted relative to the body, and a pair of pivot pins extending towards one another from opposing ends of the arms. The pivot pins enable the flashlight head to pivot about an axis extending between the pins. The arms extend from the housing at an angle inclined from a central axis of the housing, such that the axis extending between the pivot pins does not intersect the central axis of the housing.

These and other features, advantages, and objects of the present invention will be further understood and appreciated by those skilled in the art by reference to the following specification, claims, and appended drawings.

DETAILED DESCRIPTION OF THE PREFERRED EMBODIMENT

Figures 1, 2:
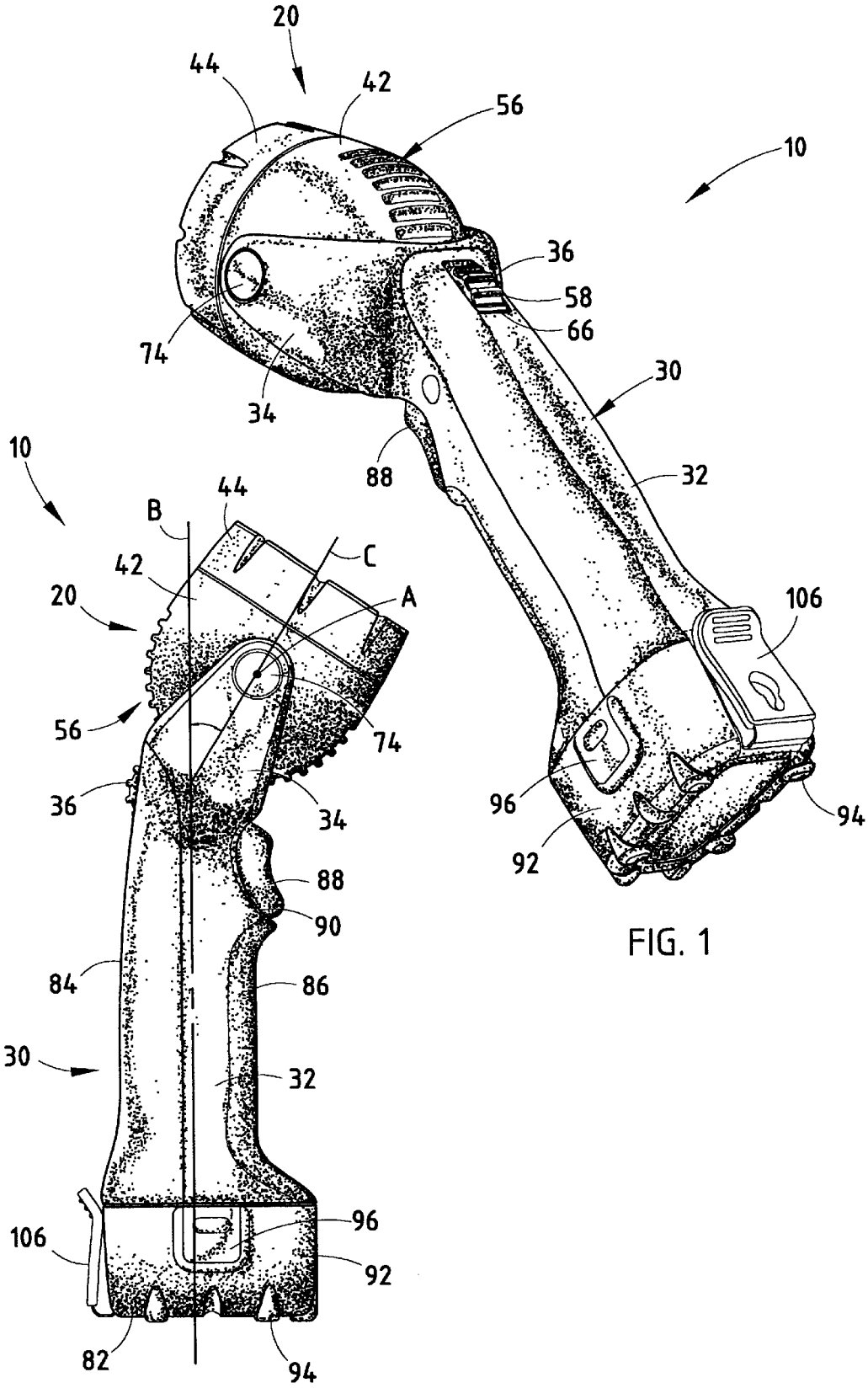
FIG. 1 is a perspective view showing the rear, top, and a first side of the flashlight of the present invention.
FIG. 2 is a perspective view showing a second side of the flashlight of the present invention.
Figure 3:
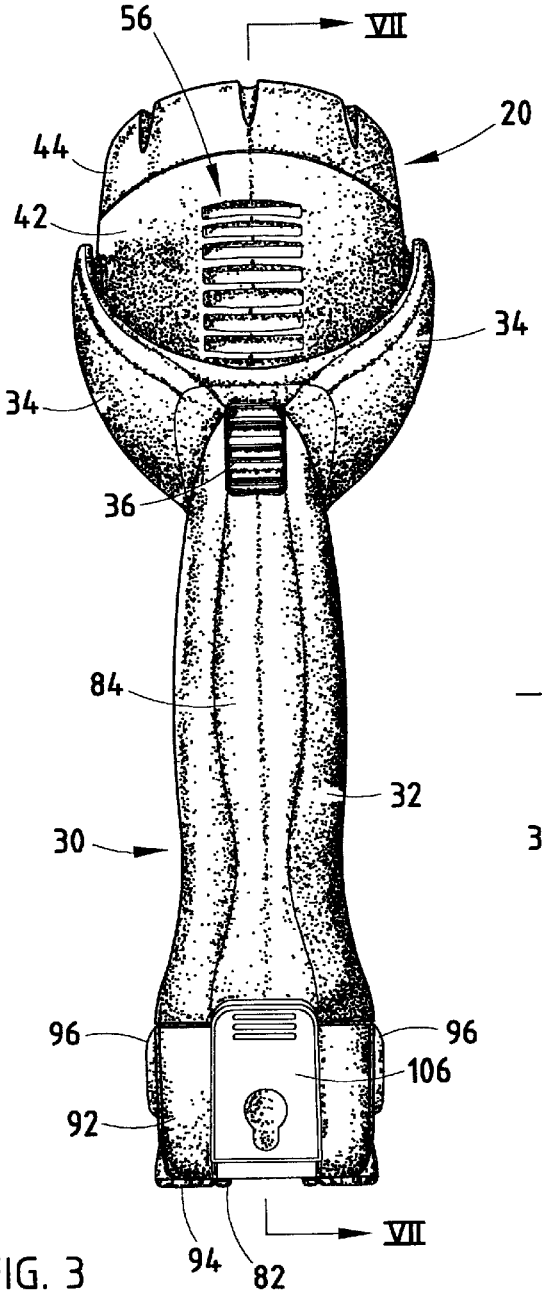
FIG. 3 is a perspective view showing the top of the flashlight of the present invention.

Reference will now be made in detail to the preferred embodiment of the invention, examples of which are illustrated in the accompanying drawings. Wherever possible, the same reference numerals will be used throughout the drawings to refer to the same or like parts.

For purposes of description herein, the terms "upper," "lower," "right," "left," "rear," "front," "vertical," "horizontal," "top," "bottom," and derivatives thereof shall relate to the invention as viewed by a person holding the flashlight in a generally horizontal position with the light beam emitted from the front of the flashlight in a forward direction. However, it is to be understood that the invention may assume various alternative orientations, except where expressly specified to the contrary. It is also to be understood that the specific device illustrated in the attached drawings and described in the following specification is simply an exemplary embodiment of the inventive concepts defined in the appended claims. Hence, specific dimensions, proportions, and other physical characteristics relating to the embodiment disclosed herein are not to be considered as limiting, unless the claims expressly state otherwise.

A flashlight 10 constructed in accordance with the present invention is generally shown in FIGS. 1–6. Referring to FIG. 1, flashlight 10 includes a flashlight head 20 and a body 30. Body 30 includes a housing 32 that defines an interior battery compartment in which batteries may be stored. Body 30 further includes a pair of arms 34 extending from a front end of housing 32. Flashlight head 20 is mounted between opposing ends of arms 34, such that flashlight head 20 may be pivoted relative to body 30. Body 30 further includes a thumb wheel 36 rotatably mounted in housing 32 and extending partially through housing 32 to engage flashlight head 20, such that flashlight head 20 pivots relative to body 30 as thumb wheel 36 is rotated.

Figure 7:
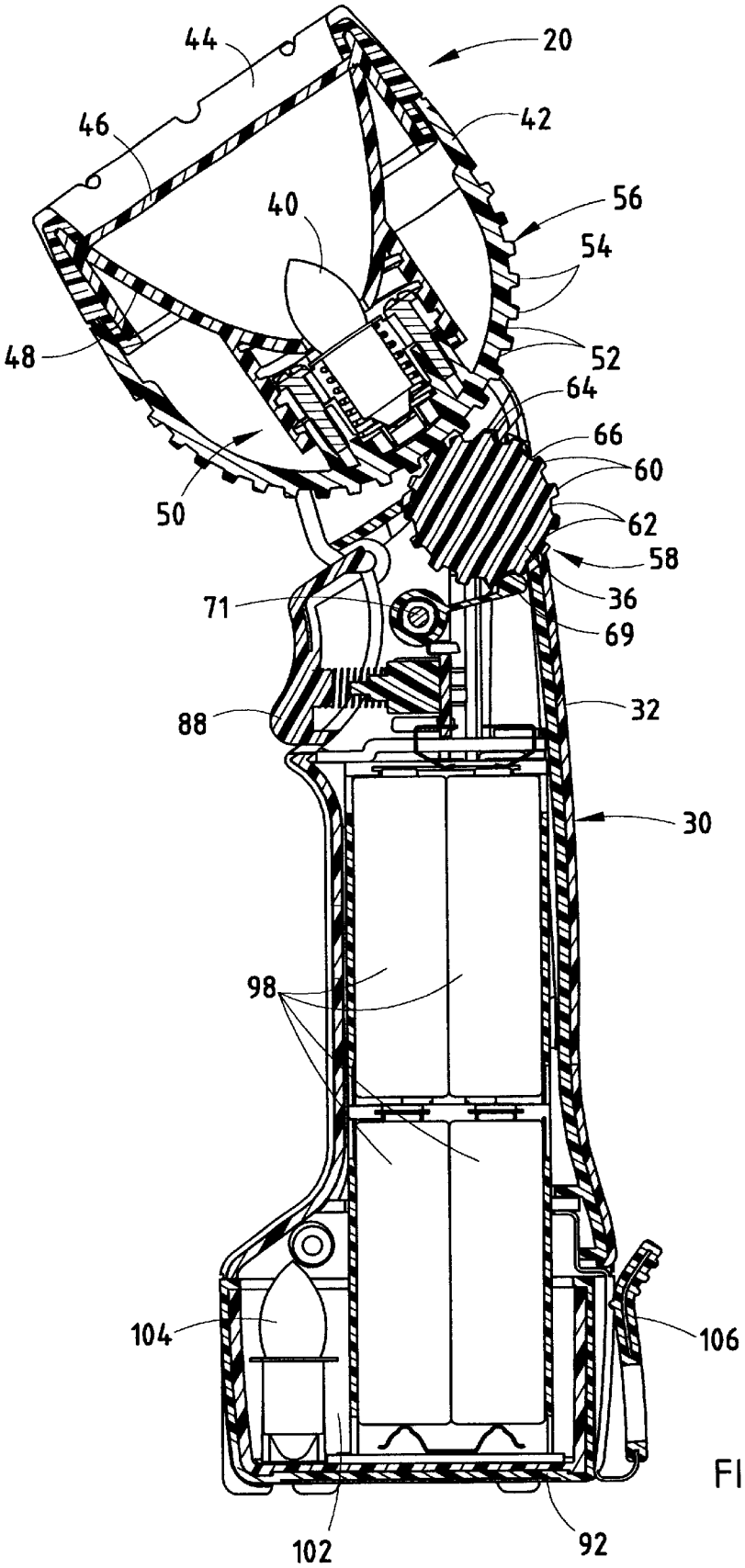
FIG. 7 is a cross-sectional view taken along line VII—VII of the flashlight shown in FIG. 3.
Figure 8:
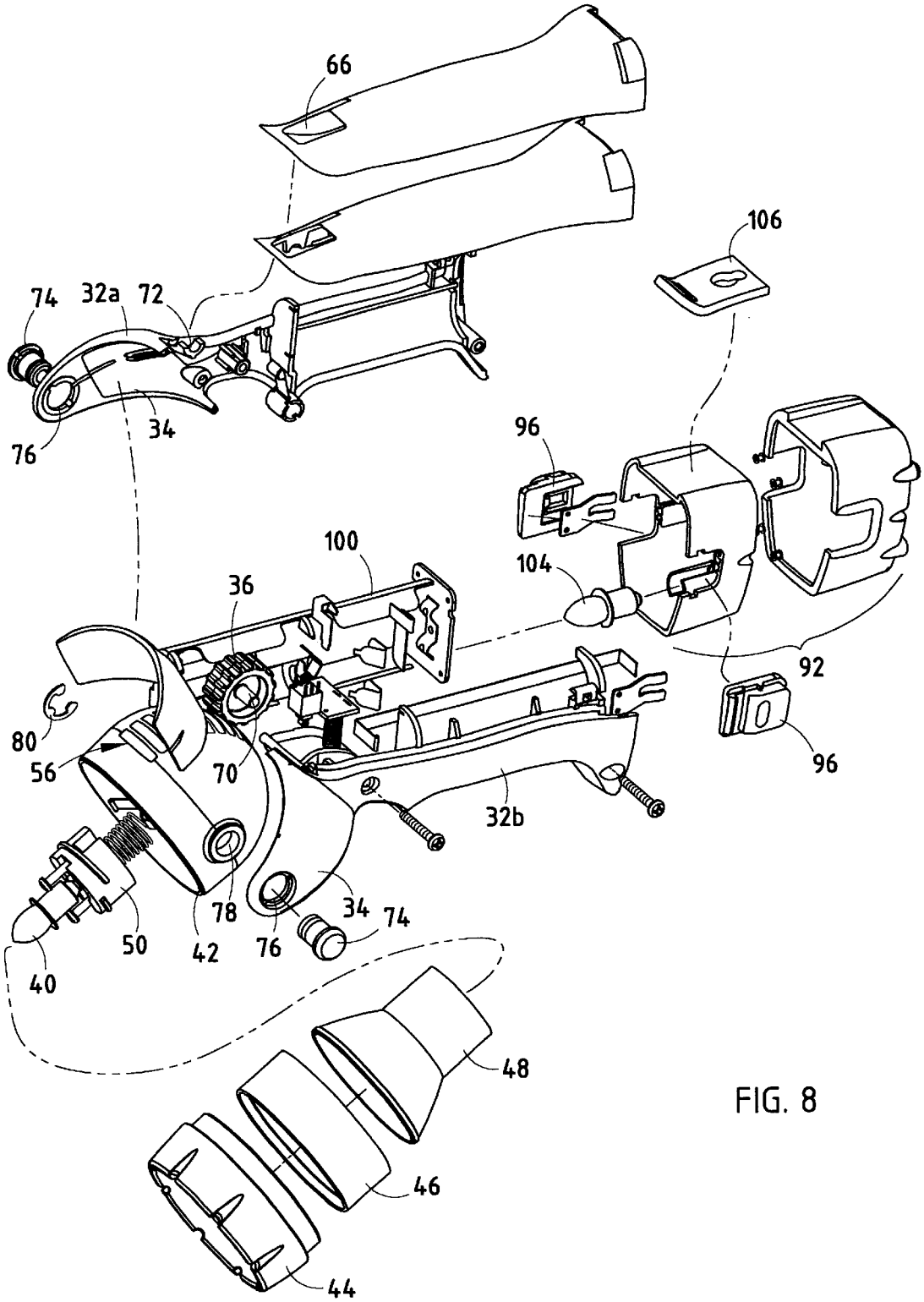
FIG. 8 is an exploded assembly view of the flashlight of the present invention.

Flashlight head 20 serves as a housing for a light bulb 40 and includes a rear housing portion 42 having a generally round or spherical rear surface. Flashlight head 20 further includes a shroud 44, a lens 46, a reflector 48, and a lens bulb holder 50 (see FIG. 7). As best shown in FIGS. 1, 7, and 8, a plurality of parallel grooves 52 are formed in the rear surface of rear housing 42 so as to define a plurality of ridges 54 that, together with grooves 52, define gear teeth 56 along a central track on the rear of flashlight head 20.

Thumb wheel 36 also includes a plurality of gear teeth 58 defined by a plurality of ridges 60 and recesses 62 along the perimeter of thumb wheel 36. As best shown in FIG. 7, gear teeth 58 of thumb wheel 36 extend through an aperture 64 in the front end of housing 32 so as to engage and intermesh with gear teeth 56 on the back of flashlight head 20. Thumb wheel 36 further extends through an aperture 66 in the top surface of body housing 32 so as to allow a person to rotate thumb wheel 36 with their thumb or another finger. Thus, as thumb wheel 36 is rotated, flashlight head 20 is caused to pivot relative to body 30.

As shown in FIG. 8, thumb wheel 36 is mounted within body 30 by means of an axle 70 that extends through the central axis of thumb wheel 36 and is received by a hub 72 that is molded in each of two portions 32*a* and 32*b* of housing 30.

As shown in FIGS. 7 and 8, a detent 69 may be mounted within housing 32 for engaging gear teeth 58 on thumb wheel 36. Detent 69 is provided to prevent thumb wheel 36 from rotating and hence prevent flashlight head 20 from pivoting as the result of vibration or the weight of flashlight head 20 preventing a user from rotating thumb wheel 36. Thus, flashlight head 20 may be prevented from pivoting when a person does not intend flashlight head 20 to pivot. To accomplish this goal, detent 69 has a rounded surface that engages the recesses 62 in thumb wheel 36. Detent 69 may be mounted around a pin 71 and may be made of a resilient material so as to be biased against thumb wheel 36, and yet be flexible enough to snap back into position into each recess 62 as thumb wheel 36 is rotated.

Flashlight head 20 is secured to body 30 by means of a pair of pivot pins 74 that extend through apertures 76 formed through opposing ends of arms 34 and into apertures 78 formed on opposite sides of rear housing 42. Lock washers 80 may be utilized to hold pivot pins 74 in place. Preferably, pivot pin 74 and apertures 76 include a tongue-and-groove configuration so as to prevent pin 74 from rotating relative to arms 34. In this manner, the electrical connections required between the batteries, switch, and light bulb 40 may be run through the interior of arms 34 and through an aperture provided in the central portion of pin 74. As is apparent from the drawing figures, pivot pins 74 are aligned along a common axis A about which flashlight head 20 pivots. This axis is generally perpendicular to a central axis B of body 30. As best illustrated in FIG. 2, arms 34 extend from the front end of body 30 at an angle, such that pivot axis A extending between pins 74 does not intersect or lie in the same plane as central axis B of body 30. The significance of such an inclination of arms 30 is that when the flashlight is set upright on its rear end on the top of a worksurface or table, flashlight head 20 may be pivoted so as to direct light downward onto the worksurface in an area directly adjacent the area upon which the flashlight rests without any component of the flashlight blocking the light that is to be directed downward onto the worksurface.

Figure 4:
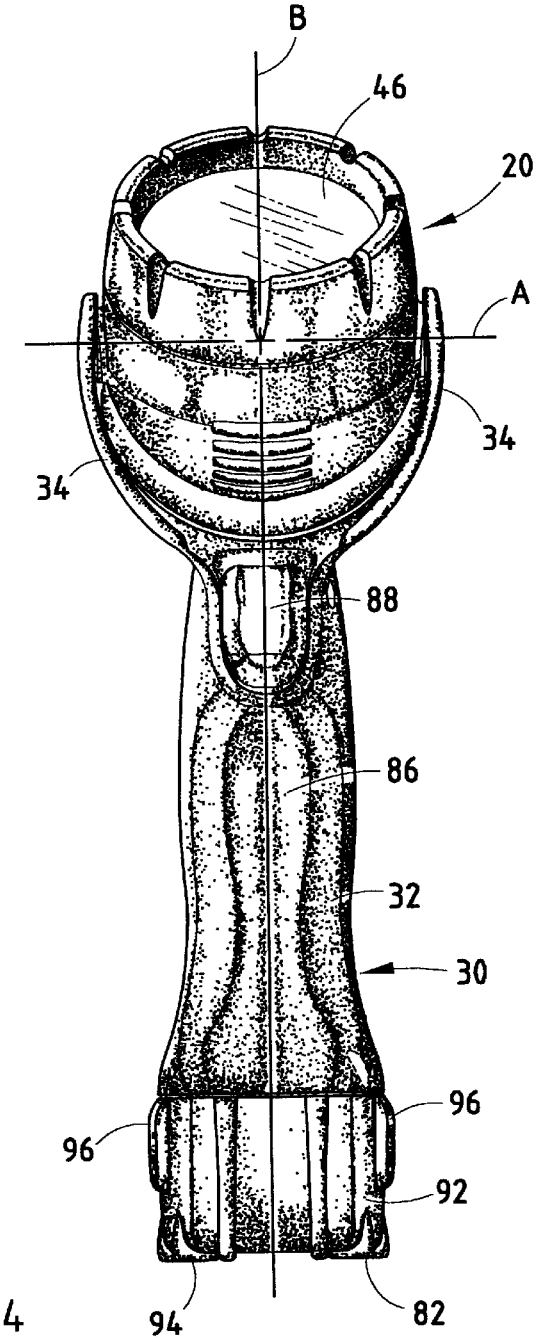
FIG. 4 is a perspective view showing the bottom of the flashlight of the present invention.
Figure 5:
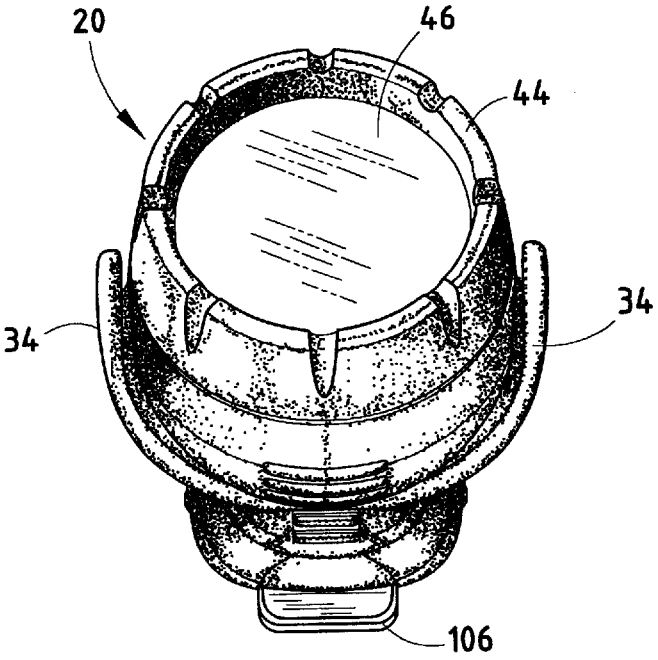
FIG. 5 is a perspective view showing the front of the flashlight of the present invention.
Figure 6:
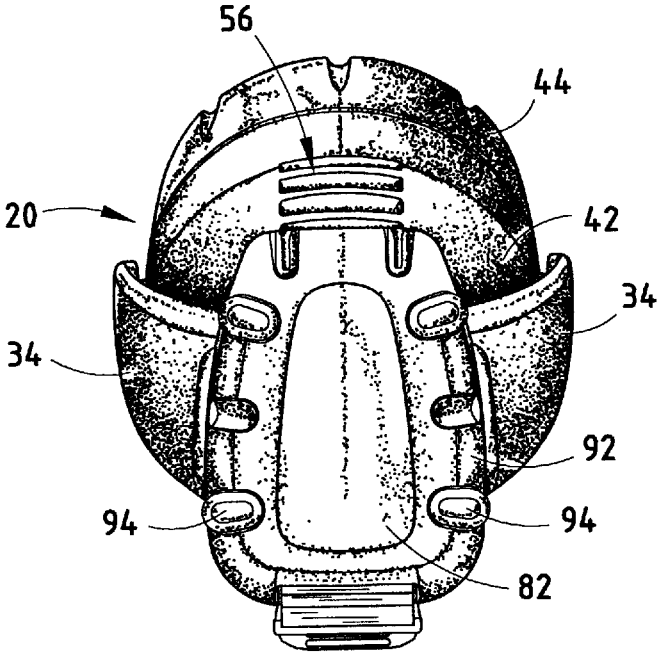
FIG. 6 is a perspective view showing the rear of the flashlight of the present invention.

As used and described herein, the "central axis" of body 30 is an axis that extends vertically upward and perpendicular to a rear surface 82 of body 30 upon which the flashlight would rest when set upright on a worksurface. As shown in FIG. 4, central axis B lies in a plane that is a plane of symmetry in the flashlight when viewed from the top or bottom of the flashlight. When viewed from a side of the flashlight (see FIG. 2), central axis B is located in a position that is on average halfway between the top surface 84 and the bottom surface 86 of body 30 in a region of body 30 where a person would normally grasp and hold the flashlight 10.

To allow a person to readily turn the flashlight on and off using their forefinger without having to change their grip on the flashlight, an on/off switch 88 is provided through an aperture 90 provided in the bottom surface 86 of flashlight body 30 in a trigger-like fashion and on an opposite side of body 30 than thumb wheel 36. As apparent from the drawing figures, body 30 is not merely cylindrical in shape, but rather is contoured similar to a pistol grip to ergonomically fit in a person's hand while allowing easy manipulation of the on/off trigger switch. This arrangement allows a person to turn the flashlight on and off with their forefinger while pivoting flashlight head 20 using thumb wheel 36 without requiring the person to change their grip on the flashlight or use their other hand. Such a configuration is a great convenience to people who have to carry other items in their other hand while using a flashlight.

Body 30 may further include a rear base cap 92 having a plurality of feet 94 that provide a stable resting surface for supporting the flashlight when placed in an upright position on rear surface 82. Rear base 92 may be selectively removed by depressing two latch buttons 96 provided on opposite sides of rear base 92. By removing rear base 92, one may gain access to the battery compartment within body 30 and hence install or replace batteries 98 (see FIG. 7). Batteries 98 may be housed in a cartridge 100 that may be slid into and out of the battery compartment. Base 92 may also be provided so as to be slightly larger than the gripping portion of body 30 to enable a more secure grip on the flashlight, to provide a wider, more stable base, and to provide a compartment 102 in which a spare flashlight bulb 104 may be contained.

Body 30 may also include a belt clip 106 that is resiliently attached to rear base 92 to allow a person to clip and carry the flashlight on their belt or on any other article of clothing or to clip or hang the flashlight on a wall or other article or to suspend the flashlight from a rope or a strap.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The invention claimed is:

1. A flashlight comprising:

a flashlight head including a light bulb; and a body including:

a housing that defines a battery compartment, a pair of arms extending from a front end of said housing for mounting said flashlight head between opposing ends of said arms such that said flashlight head may be pivoted relative to said body, and a thumb wheel rotatably mounted in said housing and extending partially through said housing to engage said flashlight head such that said flashlight head pivots relative to said body as said thumb wheel is rotated.

2. The flashlight as defined in claim 1, wherein said housing has an elongated shape contoured to fit in the palm of a person's hand.

3. The flashlight as defined in claim 2, wherein said body further includes a switch disposed partially in said body and extending through a side of said housing opposite a side of said housing through which said thumb wheel extends such that said switch may be depressed with a person's forefinger while said thumb wheel may be rotated with the person's thumb.

4. The flashlight as defined in claim 1, wherein said thumb wheel includes a plurality of gear teeth and said flashlight head includes a round rear surface having a plurality of parallel grooves for engaging said gear teeth of said thumb wheel.

5. The flashlight as defined in claim 4 and further including a detent disposed within said housing for releasably engaging said gear teeth of said thumb wheel.

6. The flashlight as defined in claim 1 and further including a pair of pivot pins extending towards one another from opposing ends of said arms, wherein said pivot pins enable said flashlight head to pivot about an axis extending between said pins.

7. The flashlight as defined in claim 6, wherein said arms extend from said housing at an angle inclined from a central axis of said housing such that the axis extending between said pivot pins does not intersect the central axis of said housing.

8. A flashlight comprising:

a body housing;

a head housing pivotally mounted to said body housing, said head housing including a round rear surface having a plurality of parallel grooves provided therein; and a thumb wheel rotatably mounted in said body housing and extending partially through a side and an end of said body housing, said thumb wheel including a plurality of gear teeth for engaging said grooves in said head housing such that said head housing pivots relative to said body housing as said thumb wheel is rotated.

9. The flashlight as defined in claim 8 and further including a battery compartment within said body housing.

10. The flashlight as defined in claim 8 and further including a detent disposed within said body housing for releasably engaging said gear teeth of said thumb wheel.

11. The flashlight as defined in claim 8 and further including a light bulb disposed in said head housing.

12. The flashlight as defined in claim 8 and further including a switch disposed partially within said body housing.

13. The flashlight as defined in claim 8, wherein said body housing includes a pair of arms extending from a front end of said body housing, and a pair of pivot pins extending towards one another from opposing ends of said arms, wherein said pivot pins enable said head housing to pivot about an axis extending between said pins.

14. The flashlight as defined in claim 13, wherein said arms extend from said body housing at an angle inclined from a central axis of said body housing such that the axis extending between said pivot pins does not intersect the central axis of said body housing.

15. A flashlight comprising:

a flashlight head including a light bulb; and a body including:

a housing that defines a battery compartment, a pair of arms extending from a front end of said housing for mounting said flashlight head between opposing ends of said arms such that said flashlight head may be pivoted relative to said body and thereby provide benchtop illumination, and a pair of pivot pins extending towards one another from opposing ends of said arms, wherein said pivot pins enable said flashlight head to pivot about an axis extending between said pins, wherein said arms extend from said housing at an angle inclined from a central axis of said housing such that the axis extending between said pivot pins does not intersect the central axis of said housing.

16. The flashlight as defined in claim 15, wherein said housing has an elongated shape contoured to fit in the palm of a person's hand.

17. The flashlight as defined in claim 16, wherein said body further includes a switch disposed partially in said body and extending through a side of said housing such that said switch may be depressed with a person's forefinger.

* * * * *